US005276247A

United States Patent [19]

Engelhardt et al.

[11] Patent Number: 5,276,247

[45] Date of Patent: Jan. 4, 1994

[54] PROCESS FOR OBTAINING THE HYDROCARBON FROM A HYDROCARBON-RICH GEL

[75] Inventors: Fritz Engelhardt, Frankfurt; Gerlinde Ebert, Dreieich/Offenthal; Werner Zschau, Germering-Unterpfaffenhofen, all of Fed. Rep. of Germany

[73] Assignee: Cassella Aktiengesellschaft, Frankfurt, Fed. Rep. of Germany

[21] Appl. No.: 947,391

[22] Filed: Sep. 21, 1992

[30] Foreign Application Priority Data

Oct. 2, 1991 [DE] Fed. Rep. of Germany ..... 4132799

[51] Int. Cl.[5] ..... C07C 7/10; C07C 7/20

[52] U.S. Cl. ..... 585/833; 585/899; 208/299; 208/177

[58] Field of Search ..... 585/833, 899; 208/299, 208/177

[56] References Cited

U.S. PATENT DOCUMENTS

| | | | |
|---|---|---|---|
| 3,064,730 | 11/1962 | Malone et al. | 166/278 |
| 3,378,418 | 4/1968 | Lissant | 149/109 |
| 3,416,320 | 12/1968 | Asher | 60/208 |
| 3,498,380 | 3/1970 | Sparlin et al. | 166/278 |
| 5,082,059 | 1/1992 | Engelhardt et al. | 166/308 |

FOREIGN PATENT DOCUMENTS

| | | |
|---|---|---|
| 0425873 | 5/1991 | European Pat. Off. . |
| 0452758 | 10/1991 | European Pat. Off. . |

OTHER PUBLICATIONS

Database WPI, Section Ch, Week 7636, Derwent Publications Ltd., Abstract of JP-A-50 051 506, May 1975 (page unavailable).

*Primary Examiner*—Anthony McFarlane
*Assistant Examiner*—Nhat D. Phan

[57] ABSTRACT

The present invention relates to a process for obtaining the hydrocarbon from a hydrocarbon-rich gel based on an ionic surfactant by treatment of the gel with a laminar mineral.

16 Claims, No Drawings

PROCESS FOR OBTAINING THE HYDROCARBON FROM A HYDROCARBON-RICH GEL

The present invention relates to a process for obtaining the hydrocarbon from a hydrocarbon-rich gel by treatment with a laminar mineral.

BACKGROUND OF THE INVENTION

Storage and transportation of liquid hydrocarbons, for example fuels, via road, rail and on the waterways present a considerable potential hazard. Thus, for example, the high flammability and explosiveness in mixtures with air has led in the past to serious accidents which have caused considerable damage. Serious ecological damage moreover is constantly arising due to fuels being discharged from leaking storage or transportation tanks.

It is already known that hydrocarbons can be converted into so-called hydrocarbon-rich gels. These are understood as meaning a system which consists of polyhedrons which are formed from surfactant and are filled with hydrocarbon, water forming a continuous phase in the narrow interstices between the polyhedrons (Angew. Chem. 100 933 (1988) and Ber. Bunsenges. Phys. Chem. 92 1158 (1988)).

Hydrocarbon-rich gels are distinguished by the occurrence of a yield value. This yield value is reached when the gel no longer withstands a stress imposed on it (shear, deformation) and starts to flow. Below the yield value, the gel structures have the properties of solids and obey Hooke's law. Above the yield value, in the ideal case, the system is equivalent to a Newtonian fluid. This means that although hydrocarbon-rich gels can be pumped in a simple manner, because of their properties as solids they cannot flow in the state of rest.

Provided that a process is available which allows the hydrocarbon to be recovered, hydrocarbon-rich gels are an outstanding form of storage and transportation. They cannot be discharged from defective storage or transportation tanks and danger to the environment is virtually excluded.

It has now been found, surprisingly, that the structure of hydrocarbon-rich gels which contain ionic surfactants can be broken down with the aid of laminar minerals and the hydrocarbon can be recovered.

SUMMARY OF THE INVENTION

The present invention thus relates to a process for obtaining the hydrocarbon from a hydrocarbon-rich gel based on an ionic surfactant by treatment of the gel with the laminar mineral which carries opposite charges to the surfactant.

DESCRIPTION OF THE PREFERRED EMBODIMENTS

The present invention thus relates to a process for obtaining the hydrocarbon from a hydrocarbon-rich gel based on an ionic surfactant by treatment of the gel with the laminar mineral which carries opposite charges to the surfactant.

Hydrocarbon-rich gels which are particularly suitable for the process according to the invention consist of 70 to 99.5% by weight of hydrocarbon, 0.01 to 15% by weight of ionic surfactant and 0.49 to 15% by weight of water.

Hydrocarbon-rich gels which are expecially suitable for the process according to the invention consist of 80 to 99.5% by weight of hydrocarbon, 0.01 to 5% by weight of ionic surfactant and 0.49 to 15% by weight of water.

Hydrocarbons which are particularly suitable for the process according to the invention are n-pentane, n-hexane, n-heptane, n-octane, n-nonane, n-decane, n-dodecane, n-tetradecane, n-hexadecane, cyclohexane, cyclooctane, benzene, toluene, kerosine, leaded and lead-free petrol, heating oil, diesel oil and crude oil.

The hydrocarbon-rich gel can contain cationic or anionic surfactants.

Preferred cationic surfactants are quaternary ammonium compounds of the formula

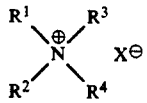

wherein $R^1$ denotes alkyl having 10 to 22 C atoms, $R^2$ denotes alkyl having 1 to 12 C atoms or benzyl, $R^3$ and $R^4$ independently of one another denote hydrogen or methyl and $X^\ominus$ denotes $Cl^\ominus$, $Br^\ominus$ or $CH_3SO_4^\ominus$;

fatty amines, such as, for example, coconut-fatty amines, lauryl-fatty amine, oleyl-fatty amine, stearyl-fatty amine, tallow-fatty amine, dimethyl-fatty amine or primary alkylamines having pure chains of 8 to 22 C atoms; ammonium borate betaine based on didecylamine; stearyl-N-acylamido-N-methyl-imidazolinium chloride of the formula

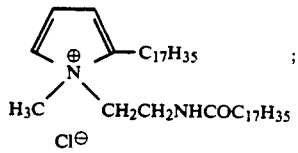

and alkenylsuccinic acid derivatives of the formulae

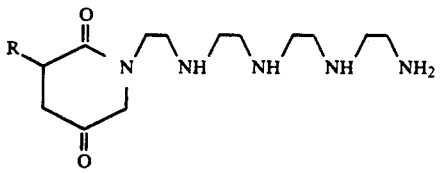

or

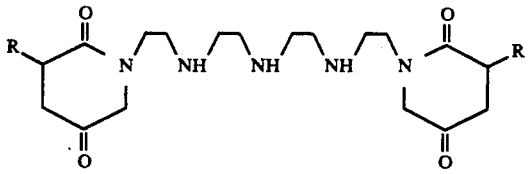

wherein R in each case denotes iso-$C_{18}H_{35}$ or polybutenyl.

Preferred anionic surfactants are soaps of the formula $$R—CH_2—COO^\ominus Na^\oplus$$

wherein R denotes a hydrocarbon radical having 10 to 20 C atoms;

alkanesulphonates of the formula

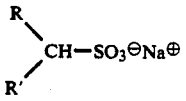

wherein R and R' denote alkyl radicals having together 11 to 17 C atoms;

alkylbenzenesulphonates or -sulphates of the formula

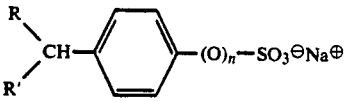

wherein n is 0 or 1 and R and R' denote alkyl radicals having together 11 to 13 C atoms;

olefinsulphonates of the formula $R—CH_2—CH=CH—CH_2—SO_3^{\ominus}Na^{\oplus}$ wherein R denotes alkyl having 10 to 14 C atoms;

fatty alcohol sulphates of the formula $R—CH_2—O—SO_3^{\ominus}Y^{\oplus}$ wherein R denotes alkyl having 11 to 15 C atoms and $Y^{\oplus}$ denotes $Na^{\oplus}$ or triethanolamine;

fatty alcohol polyglycol sulphates of the formula $$R—CH_2—O(C_2H_4O)_n—SO_3^{\ominus}Na^{\oplus}$$

wherein n is 2 to 7 and

R denotes alkyl having 8 to 15 C atoms;

sulphosuccinates of the formula $$R—CH_2—O(C_2H_4O)_n—\overset{\overset{O}{\|}}{C}—\underset{\underset{SO_3^{\ominus}Na^{\oplus}}{|}}{CH}—CH_2COO^{\ominus}Na^{\oplus}$$

wherein n is 2 to 6 and

R denotes alkyl having 11 to 13 C atoms;

fatty alcohol polyglycol phosphates of the formula $$R—CH_2—O(C_2H_4O)_nPO_3H^{\ominus}Na^{\oplus}$$

wherein n is 2 to 6 and

R denotes alkyl having 15 to 17 C atoms;

alkanephosphonates of the formula $$R—PO_3H^{\ominus}Na^{\oplus}$$

wherein R denotes alkyl having 12 to 16 C atoms;

or sodium salts of oleic acid derivatives, such as oleic acid sarcoside, oleic acid isothionate or oleic acid methyltauride.

If the hydrocarbon-rich gel contains a cationic surfactant, the laminar mineral used must carry negative charges. Laminar silicates having negative charges, for example, are suitable.

Preferred laminar silicates of this type are, in particular, the so-called bentonites. Either the unchanged naturally occurring products or else treated, in particular acid-treated, naturally occurring products can be used. Laminar silicates of the smectite type are particularly preferred.

If the hydrocarbon-rich gel contains an anionic surfactant, the laminar mineral used must carry positive charges. Preferred laminar minerals of this type are, in particular, the hydrotalcites.

The recovery of the hydrocarbon, that is to say the breakdown of the gel structure, is preferably carried out by adding the laminar material to the gel as a solid and shaking the mixture briefly. Disintegration of the gel then starts spontaneously and is faster, the more laminar mineral is added. Reasonable gel distintegration rates are achieved, depending on the system, when 50 to 500 mg, particularly preferably 500 to 3000 ppm, of laminar mineral are added per 100 g of gel.

In particularly preferred embodiments of the process according to the invention, the hydrocarbon-rich gel is filtered through a layer of laminar mineral or pumped through a column charged with laminar mineral.

EXAMPLE 1

1.6 g of a commercially available cationic surfactant based on a quaternary ammonium salt were dissolved in 6.4 g of water and the solution was initially introduced into a wide-necked conical flask. 392 g of kerosine were added at room temperature, while stirring vigorously by means of a magnetic stirrer. A hydrocarbon-rich gel system was formed by this procedure.

The gel thus obtained was initially introduced into a 500 ml conical flask with a ground glass joint, 692 mg of bentonite EX 0027 (Süd-Chemie AG, Munich) were added and the mixture was shaken manually. The system was broken down spontaneously and 392 g of kerosine were recovered.

EXAMPLE 2

580 mg of the bentonite EX 0022 (Süd-Chemie AG, Munich) were spread thoroughly over the entire base of a suction filter (pore width 1, tray diameter 95 mm, diameter of the stem: 22 mm, code 25 D). The suction filter was placed on a suction bottle (conical shape, 1000 ml, DIN 12476, ISO 655) together with a rubber seal (external diameter, top: 63 mm, external diameter, bottom: 43 mm, internal diameter, bottom: 33 mm), and the suction bottle in turn was connected to a water-jet pump via a hose. After the water-jet pump had been started, a system, prepared as in Example 1, from 0.18 g of a commercially available cationic surfactant based on a quaternary ammonium salt, 17.82 g of water and 382 g of ligroin was added all at once to the bentonite initially introduced into the suction filter. The system was broken down spontaneously and 382 g of ligroin were collected in the suction bottle.

The gels of the following examples 3 to 41 were prepared analogously to Example 1 and broken down with the stated amounts of laminar silicate as in Example 1 or 2. The following abbreviations are used here:

A = bentonite EX 0027 (Süd-Chemie AG, Munich)
B = bentonite EX 0022 (Süd-Chemie AG, Munich)
C = bentonite EX 0002 (Süd-Chemie AG, Munich)
16 = hexadecyltrimethylammonium chloride
13 = dimethyldidecylammonium chloride
15 = di-coconut-alkyldimethylammonium chloride
18 = coconut-alkyldimethylbenzylammonium chloride
2 = trimethyldodecylammonium chloride
17 = stearyldimethylbenzylammonium chloride
7 = commercially available surfactant based on tallow-fatty amine
8 = commercially available surfactant based on stearyl-fatty amine.

| Example | Cationic surfactant | Gel composition in % by weight | | | Laminar silicate | Amount for breakdown of 1 g of gel in mg |
|---|---|---|---|---|---|---|
| | | Ligroin | Surfactant | Water | | |
| 3 | 16 | 99.0 | 0.05 | 0.95 | A | 2.94 |
| 4 | 16 | 99.0 | 0.05 | 0.95 | B | 1.96 |
| 5 | 16 | 99.0 | 0.05 | 0.95 | C | 2.45 |
| 6 | 13 | 95.421 | 0.046 | 4.527 | A | 5.00 |
| 7 | 13 | 95.421 | 0.046 | 4.527 | B | 3.20 |
| 8 | 13 | 95.421 | 0.046 | 4.527 | C | 3.53 |
| 9 | 15 | 93.22 | 0.068 | 6.712 | A | 2.26 |
| 10 | 15 | 93.22 | 0.068 | 6.712 | B | 1.67 |
| 11 | 15 | 93.22 | 0.068 | 6.712 | C | 1.20 |
| 12 | 18 | 99.2 | 0.04 | 0.76 | A | 2.71 |
| 13 | 18 | 99.2 | 0.04 | 0.76 | B | 2.14 |
| 14 | 18 | 99.2 | 0.04 | 0.76 | C | 1.95 |
| 15 | 2 | 98.3 | 0.085 | 1.615 | A | 2.87 |
| 16 | 2 | 98.3 | 0.085 | 1.615 | B | 1.67 |
| 17 | 2 | 98.3 | 0.085 | 1.615 | C | 2.34 |
| 18 | 16 | 94.595 | 0.054 | 5.351 | A | 2.53 |
| 19 | 16 | 94.595 | 0.054 | 5.351 | B | 4.43 |
| 20 | 16 | 94.595 | 0.054 | 5.351 | C | 6.27 |
| 21 | 13 | 97.8 | 0.11 | 2.09 | A | 1.14 |
| 22 | 13 | 97.8 | 0.11 | 2.09 | B | 0.43 |
| 23 | 13 | 97.8 | 0.11 | 2.09 | C | 0.89 |
| 24 | 17 | 94.915 | 0.051 | 5.034 | A | 2.10 |
| 25 | 17 | 94.915 | 0.051 | 5.034 | B | 1.90 |
| 26 | 17 | 94.915 | 0.051 | 5.034 | C | 1.70 |
| 27 | 18 | 93.63 | 0.064 | 6.306 | A | 2.00 |
| 28 | 18 | 93.63 | 0.064 | 6.306 | B | 1.90 |
| 29 | 18 | 93.63 | 0.064 | 6.306 | C | 0.86 |
| 30 | 15 | 99.0 | 0.04 | 0.96 | A | 0.96 |
| 31 | 15 | 99.0 | 0.04 | 0.96 | B | 1.45 |
| 32 | 15 | 99.0 | 0.04 | 0.96 | C | 2.36 |
| 33 | 2 | 96.9 | 0.155 | 2.945 | A | 3.05 |
| 34 | 2 | 96.9 | 0.155 | 2.945 | B | 1.73 |
| 35 | 2 | 96.9 | 0.155 | 2.945 | C | 2.64 |
| 36 | 7 | 94.915 | 0.051 | 5.034 | A | 1.60 |
| 37 | 7 | 94.915 | 0.051 | 5.034 | B | 1.90 |
| 38 | 7 | 94.915 | 0.051 | 5.034 | C | 5.50 |
| 39 | 8 | 94.502 | 0.055 | 5.44 | A | 6.50 |
| 40 | 8 | 94.502 | 0.055 | 5.44 | B | 9.20 |
| 41 | 8 | 94.502 | 0.055 | 5.44 | C | 10.90 |

We claim:

1. Process for obtaining hydrocarbon from a hydrocarbon-rich gel containing an ionic surfactant wherein said ionic surfactant is cationic or anionic, comprising treating the gel with a laminar mineral wherein said laminar mineral carries negative charges when the surfactant is cationic and said laminar material carries positive charges when the surfactant is anionic.

2. Process according to claim 1, wherein the hydrocarbon-rich gel consists of 70 to 99.5% by weight of hydrocarbon, 0.01 to 15% by weight of ionic surfactant and 0.49 to 15% by weight of water.

3. Process according to claim 2, wherein the hydrocarbon-rich gel consists of 80 to 99.5% by weight of hydrocarbon, 0.01 to 5% by weight of ionic surfactant and 0.49 to 15% by weight of water.

4. Process according claim 1, wherein the hydrocarbon is selected from the group consisting of n-pentane, n-hexane, n-heptane, n-octane, n-nonane, n-decane, n-dodecane, n-tetradecane, n-hexadecane, cyclohexane, cyclooctane, benzene, toluene, kerosine, leaded and lead-free petrol, heating oil, diesel oil and crude oil.

5. Process according to claim 2, wherein the hydrocarbon is selected from the group consisting of n-pentane, n-hexane, n-heptane, n-octane, n-nonane, n-decane, n-dodecane, n-tetradecane, n-hexadecane, cyclohexane, cyclooctane, benzene, toluene, kerosine, leaded and lead-free petrol, heating oil, diesel oil and crude oil.

6. Process according to claim 3, wherein the hydrocarbon is selected from the group consisting of n-pentane, n-hexane, n-heptane, n-octane, n-nonane, n-decane, n-dodecane, n-tetradecane, n-hexadecane, cyclohexane, cyclooctane, benzene, toluene, kerosine, leaded and lead-free petrol, heating oil, diesel oil and crude oil.

7. Process according to claim 1, wherein the cationic surfactant is selected from the group consisting of a) quaternary ammonium compounds of the formula

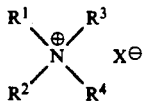

wherein $R^1$ denotes alkyl having 10 to 22 C atoms, $R^2$ denotes alkyl having 1 to 12 C atoms or benzyl, $R^3$ and $R^4$ independently of one another denote hydrogen or methyl and $X^\ominus$ denotes $Cl^\ominus$, $Br^\ominus$ or $CH_3SO_4^\ominus$;

b) fatty amines;

c) ammonium borate betaine based on didecylamine;

d) stearyl-N-acylamide-N-methyl-imidazolinium chloride of the formula

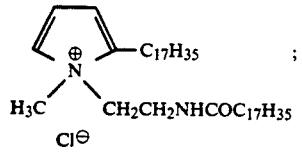

; and e) alkenylsuccinic acid of the formulae

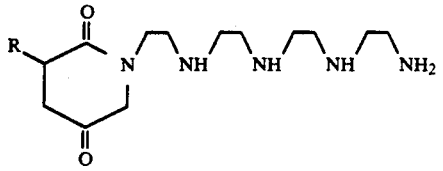

or

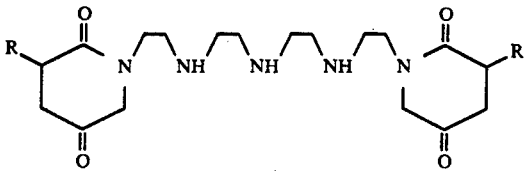

wherein R in each case denote iso-$C_{18}H_{35}$ or polybutenyl.

8. Process according to claim 6, wherein the cationic surfactant is selected from the group consisting of a) quaternary ammonium compounds of the formula

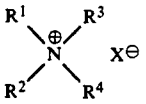

wherein $R^1$ denotes alkyl having 10 to 22 C atoms, $R^2$ denotes alkyl having 1 to 12 C atoms or benzyl, $R^3$ and $R^4$ independently of one another denote hydrogen or methyl and $X^{\ominus}$ denotes $Cl^{\ominus}$, $Br^{\ominus}$ or $CH_3SO_4^{\ominus}$;

b) fatty amines;

c) ammonium borate betaine based on didecylamine;

d) stearyl-N-acylamide-N-methyl-imidazolinium chloride of the formula

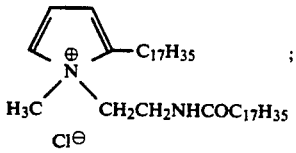

; and e) alkenylsuccinic acid of the formulae

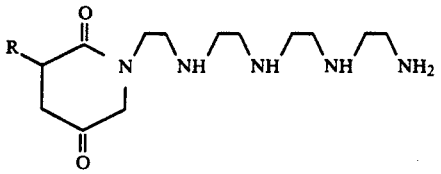

or

-continued

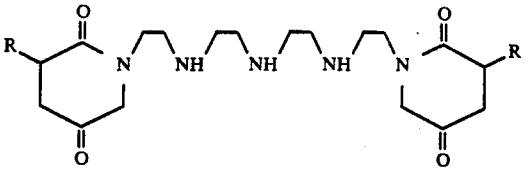

wherein R in each case denote iso-$C_{18}H_{35}$ or polybutenyl.

9. Process according to claim 1, wherein the anionic surfactants are selected from the group consisting of a) soaps of the formula $R—CH_2—COO^{\ominus}Na^{\oplus}$ wherein $R^5$ denotes a hydrocarbon radical having 10 to 20 C atoms;

b) alkanesulphonates of the formula

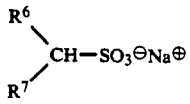

wherein $R^6$ and $R^7$ denote alkyl radicals having together 11 to 17 C atoms;

c) alkylbenzenesulphonates and -sulphates of the formula

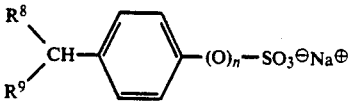

wherein n is 0 or 1 and $R^8$ and $R^9$ denote alkyl radicals having together 11 to 13 C atoms;

d) olefinsulphonates of the formula $R^{10}—CH_2—CH{=}CH—CH_2—SO_3^{\ominus}Na^{\oplus}$ wherein $R^{10}$ denotes alkyl having 10 to 14 C atoms;

e) fatty alcohol sulphates of the formula $R^{11}—CH_2—O—SO_3^{\ominus}Y^{\oplus}$ wherein $R^{11}$ denotes alkyl having 11 to 15 C atoms and $Y^{\oplus}$ denotes $Na^{\oplus}$ or triethanolamine;

f) fatty alcohol polygylcol sulphates of the formula $$R^{12}—CH_2—O(C_2H_4O)_n—SO_3^{\ominus}Na^{\oplus}$$

wherein n is 2 to 7 and $R^{12}$ denotes alkyl having 8 to 15 C atoms;

g) sulphosuccinates of the formula

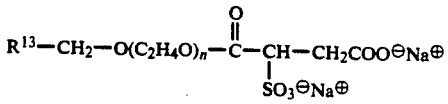

wherein n is 2 to 6 and $R^{13}$ denotes alkyl having 11 to 13 C atoms;

h) fatty alcohol polyglycol phosphates of the formula $$R^{14}—CH_2—O(C_2H_4O)_nPO_3H^{\ominus}Na^{\oplus}$$

wherein n is 2 to 6 and $R^{14}$ denotes alkyl having 15 to 17 C atoms;

i) alkanephosphonates of the formula $R^{15}—PO_3H^{\ominus}Na^{\oplus}$ wherein $R^{15}$ denotes alkyl having 12 to 16 C atoms; and j) sodium salts of oleic acids.

10. Process according to claim 6, wherein the anionic surfactants are selected from the group consisting of a) soaps of the formula $R—CH_2—COO^{\ominus}Na^{\oplus}$ wherein $R^5$ denotes a hydrocarbon radical having 10 to 20 C atoms;

b) alkanesulphonates of the formula

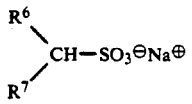

wherein $R^6$ and $R^7$ denote alkyl radicals having together 11 to 17 C atoms;

c) alkylbenzenesulphonates and -sulphates of the formula

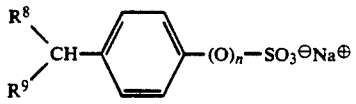

wherein n is 0 or 1 and $R^8$ and $R^9$ denote alkyl radicals having together 11 to 13 C atoms;

d) olefinsulphonates of the formula $R^{10}—CH_2—CH=CH—CH_2—SO_3^{\ominus}Na^{\oplus}$ wherein $R^{10}$ denotes alkyl having 10 to 14 C atoms;

e) fatty alcohol sulphates of the formula $R^{11}—CH_2—O—SO_3^{\ominus}Y^{\oplus}$ wherein $R^{11}$ denotes alkyl having 11 to 15 C atoms and $Y^{\oplus}$ denotes $Na^{\oplus}$ or triethanolamine;

f) fatty alcohol polygylcol sulphates of the formula $$R^{12}—CH_2—O(C_2H_4O)_n—SO_3^{\ominus}Na^{\oplus}$$

wherein n is 2 to 7 and $R^{12}$ denotes alkyl having 8 to 15 C atoms;

g) sulphosuccinates of the formula $$R^{13}—CH_2—O(C_2H_4O)_n—\overset{O}{\overset{\|}{C}}—\underset{SO_3^{\ominus}Na^{\oplus}}{\underset{|}{CH}}—CH_2COO^{\ominus}Na^{\oplus}$$

wherein n is 2 to 6 and $R^{13}$ denotes alkyl having 11 to 13 C atoms;

h) fatty alcohol polyglycol phosphates of the formula $$R^{14}—CH_2—O(C_2H_4O)_nPO_3H^{\ominus}Na^{\oplus}$$

wherein n is 2 to 6 and $R^{14}$ denotes alkyl having 15 to 17 C atoms;

i) alkanephosphonates of the formula $R^{15}—PO_3H^{\ominus}Na^{\oplus}$ wherein $R^{15}$ denotes alkyl having 12 to 16 C atoms; and j) sodium salts of oleic acids.

11. Process according to claim 1, wherein laminar minerals silicates are smectite and are employed for breaking down hydrocarbon-rich gels containing cationic surfactants.

12. Process according to claim 8, wherein laminar minerals are smectite and are employed for breaking down hydrocarbon-rich gels containing cationic surfactants.

13. Process according to claim 1, wherein hydrotalcites are employed for breaking down hydrocarbon-rich gels containing anionic surfactants.

14. Process according to claim 10, wherein hydrotalcites are employed for breaking down hydrocarbon-rich gels containing anionic surfactants.

15. Process according to claim 7, wherein $X^{\ominus}$ is selected from the group consisting of $Cl^{\ominus}$, $Br^{\ominus}$, $CH_3SO_4^{\ominus}$, coconut-fatty amines, lauryl-fatty amine, oleyl-fatty amine, stearyl-fatty amine, tallow-fatty amine, dimethyl-fatty amine and primary alkylamines having pure chains of 8 to 22 C atoms.

16. Process according to claim 9, wherein said sodium salts of oleic acids of group j), are selected from the group consisting of oleic acid sarcoside, oleic acid isothionate and oleic acid methyl tauride.

* * * * *